US007285516B2

(12) United States Patent
Carrick et al.

(10) Patent No.: US 7,285,516 B2
(45) Date of Patent: Oct. 23, 2007

(54) ADDITIVE FORMULATION FOR LUBRICATING OILS

(75) Inventors: Virginia A. Carrick, Chardon, OH (US); William D. Abraham, South Euclid, OH (US); Gordon D. Lamb, Southend Bradfield (GB); R. Ian Wilby, Wingerworth (GB); James P Roski, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 353 days.

(21) Appl. No.: 10/305,526

(22) Filed: Nov. 25, 2002

(65) Prior Publication Data

US 2004/0102335 A1 May 27, 2004

(51) Int. Cl.
*C10M 141/08* (2006.01)

(52) U.S. Cl. ..... 508/192; 508/372; 508/374; 508/390; 508/409; 508/414; 508/415; 508/479; 508/501; 508/502; 508/572; 508/585; 508/586

(58) Field of Classification Search ..... 508/192
See application file for complete search history.

(56) References Cited

U.S. PATENT DOCUMENTS

| | | | | |
|---|---|---|---|---|
| 6,200,936 | B1 | 3/2001 | Moreton | 508/479 |
| 6,310,009 | B1 | 10/2001 | Kocsis et al. | 508/186 |
| 6,331,510 | B1 * | 12/2001 | Curtis et al. | 508/578 |
| 6,340,659 | B1 | 1/2002 | Kocsis et al. | 508/518 |
| 6,583,092 | B1 * | 6/2003 | Carrick et al. | 508/198 |
| 6,846,782 | B2 * | 1/2005 | Calder | 508/293 |

FOREIGN PATENT DOCUMENTS

| | | | |
|---|---|---|---|
| WO | WO 01/56968 | | 8/2001 |
| WO | WO 02/062930 | A | 8/2002 |
| WO | WO 03/104620 | A | 12/2003 |
| WO | WO 2004/096957 | A1 * | 11/2004 |

OTHER PUBLICATIONS

Mortier et al, "Chemistry and Technology of Lubricants," 2d ed 1997, pp. 77-82.

* cited by examiner

*Primary Examiner*—Ellen M. McAvoy
(74) *Attorney, Agent, or Firm*—David M. Shold; Christopher D. Hilker

(57) ABSTRACT

Lubricating oils containing an additive formulation including at least one sulphonate, saligenin and salixarate detergent provide improved wear performance and decreased sulphur and phosphorus emissions.

17 Claims, No Drawings

ADDITIVE FORMULATION FOR LUBRICATING OILS

FIELD OF THE INVENTION

The present invention relates to the use of an additive formulation composition comprising in combination at least one sulphonate, saligenin, and salixarate detergent used in lubricating compositions. Optionally an additional detergent can be included. The use of saligenin and salixarate can allow reductions in the amount of overbased sulphonate detergent or sulphur-containing phenate detergent and zinc dialkyldithiophosphate, especially in diesel engines.

BACKGROUND OF THE INVENTION

It is well known for lubricating oils to contain a number of additives used to protect the engine from wear, soot deposits and acidity build up. Common additives for engine lubricating oils include zinc dialkyldithiophosphate (ZDDP) an antiwear additive, and overbased calcium sulphonate and calcium phenate detergents. It is believed that ZDDP antiwear additives protect the engine by forming a protective film on metal surfaces. Detergents such as overbased calcium sulphonate help keep the engine parts clean of soot and other deposits, and offer an alkalinity reserve. Typical treatment quantities of ZDDP range from 1 to 2 weight percent based on the total weight of the lubricant. Typical treatment quantities of overbased calcium sulphonate range from 0.05 to 5 weight percent based on the total weight of the lubricant.

In recent years phosphorus compounds and sulphur (from sulphonates, sulphur-containing phenates, and other materials such as metal-containing dithiophosphates) derived from engine lubricants have been shown to contribute in part to particulate emissions. Also, sulphur and phosphorus tend to poison the catalysts used in catalytic converters, resulting in a reduction in performance of said catalysts.

However, any reduction in the amount of ZDDP or overbased calcium sulphonates or phenates will reduce the antiwear, detergent, and reserve alkalinity properties of the lubricant. Therefore there is a need for an additive package that will reduce sulphur and phosphorus content without having an adverse effect on these properties of lubricant oil.

U.S. Pat. No. 6,310,009, Kocsis et al., Oct. 30, 2001, relates to the use of saligenin derivatives used in lubricating compositions. The formulations contain borated or non-borated magnesium saligenin derivatives. These compositions exhibit improved seal compatibility and reduced copper and lead corrosion.

U.S. Pat. No. 6,200,936, Moreton, Mar. 13, 2001, relates to the use of salixarate compounds as an additive for finished lubricating oils. The compositions disclosed are particularly suitable for medium or low speed diesel engines, especially four-stroke trunk piston engines.

PCT publication WO 01/56968, Aug. 9, 2001, relates to the use of salixarate type compounds used in lubricating oils. The compositions disclosed are particularly suitable as thermal stabilisers for medium or low speed diesel engines.

The present invention provides an additive formulation for lubricating oils capable of decreasing sulphur and phosphorus containing emissions. It further can lead to decreased engine wear and decreased corrosion. The invention further provides an additive formulation for lubricating oils with low phosphorus and sulphur content capable of meeting or exceeding current requirements of engine cleanliness, wear protection, and alkalinity. It further provides an additive formulation for lubricating oils capable of producing reduced amounts of ash and capable of improving seal compatibility.

SUMMARY OF THE INVENTION

The present invention provides a composition comprising:

a. a mono- or divalent metal sulphonate detergent;

b. a mono-or divalent metal salixarate detergent;

c. a mono-or divalent metal saligenin detergent; and d. optionally an additional mono- or divalent metal detergent other than (a), (b) or (c); and, an oil of lubricating viscosity.

In one embodiment, the mono- or divalent metal can comprise calcium, magnesium, lithium, potassium or sodium.

It further provides a lubricant composition comprising a major amount of oil of lubricating viscosity and a minor amount of at least one of each of the following:

a. a detergent, b. a dispersant, c. an antiwear agent, and d. an antioxidant;

characterised in that the detergent comprises in combination at least one mono- or divalent metal sulphonate detergent, at least one mono- or divalent metal salixarate detergent, and at least one mono- or divalent metal saligenin detergent, and optionally an additional mono- or divalent metal detergent other than the foregoing.

The invention further provides a method for lubricating an internal combustion engine, comprising supplying thereto a lubricant comprising the composition as described herein.

The use of a combination of a metal sulphonate, metal salixarate, and metal saligenin allows a reduction in the amount of metal sulphonate detergents and metal dialkyldithiophosphosphates and related antiwear additives levels in the lubricating oil composition. This reduction in phosphorus and sulphur containing additives allows the development of a formulation that meets current lubricating oil requirements with a lubricant having low phosphorus and sulphur content.

DETAILED DESCRIPTION OF THE INVENTION

Hereinafter the saligenin detergent, salixarate detergent, and sulphonate detergent are referred to as saligenin, salixarate and sulphonate. Unless otherwise stated all weight percents are based on the amount of finished lubricant.

It has been found, that an additive formulation used in a lubricating composition, comprising an oil of lubricating viscosity, in combination at least one detergent mono- or divalent metal sulphonate, at least one detergent mono- or divalent metal salixarate and at least one detergent mono- or divalent metal saligenin produces reduced amounts of sulphur, phosphorus, ash, engine wear and corrosion. The additive formulation is described as follows:

Additive Composition

Generally, the composition of the present invention comprises:

a. a mono- or divalent metal sulphonate in an amount 0.05 to 1.5 weight percent;

b. a mono- or divalent metal salixarate in an amount 0.1 to 5 weight percent;

c. a mono- or divalent metal saligenin in an amount 0.1 to 4.2 weight percent and d. an oil of lubricating viscosity in an amount up to 99.75 weight percent Often the additive formulation in oil with a lubricating viscosity lubricant composition comprises said sulphonate in an amount 0.1 to 1.2 weight percent. More preferably said sulphonate is present in an amount 0.15 to 0.8 weight percent.

Often the additive formulation in oil with a lubricating viscosity lubricant composition comprises said salixarate in an amount 0.15 to 3 weight percent. More preferably said salixarate is present in an amount 0.2 to 2 weight percent.

Often the additive formulation in oil with a lubricating viscosity comprises said saligenin in an amount 0.15 to 3 weight percent. More preferably said saligenin is present in an amount 0.2 to 1.7 weight percent.

If the present invention is in the form of a concentrate (which can be combined with additional oil to form, in whole or in part, a finished lubricant), the amount of each of the above-mentioned detergents, as well as the other components, will be present in a concentration which is approximately 5 or 10-fold greater than the values given above. The amount of oil will be correspondingly reduced.

Often the additive formulation in oil with a lubricating viscosity, i.e., as a fully formulated lubricant composition, has a total sulphur content below 0.5 weight percent. More preferably, the total sulphur content is below 0.3 weight percent.

Often the additive formulation in oil with a lubricating viscosity, i.e., as a fully formulated lubricant composition, has a total phosphorus content below 0.1 weight percent. More preferably, the total phosphorus content is below 0.085 or even 0.06, 0.055, or 0.05 weight percent or lower. It is noted that a common source of phosphorus in engine lubricants is zinc dialkyl dithiophosphate (ZDDP), a very commonly used anti-wear agent. The present invention encompasses formulations which contain ZDDP at an appropriate level.

Often the additive formulation in oil with a lubricating viscosity, i.e., as a fully formulated lubricant composition, has a total sulphated ash content below 1.5 weight percent. More preferably the sulphated ash content is below 1.1 weight percent or even 1.0, 0.8 or 0.5 weight percent.

Saligenin Derivative

The saligenin component of the additive formulation can be represented by the formula:

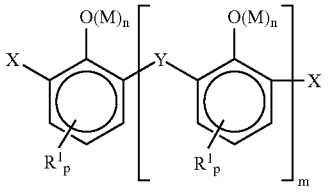

wherein X comprises —CHO or —$CH_2OH$, Y comprises —$CH_2$— or —$CH_2OCH_2$—, and wherein such —CHO groups comprise at least 10 mole percent of the X and Y groups; M is a mono- or di-valent metal ion. Each n is independently 0 or 1. $R^1$ is a hydrocarbyl group containing 1 to 60 carbon atoms, m is 0 to 10, and when m>0, one of the X groups can be H; each p is independently 0, 1, 2 or 3, preferably 1; and that the total number of carbon atoms in all $R^1$ groups is at least 7.

When n is 0, M is replaced by H to form an unneutralised phenolic —OH group. The average number of unneutralised phenolic groups can be between 0 and 100 percent. This results in the compound being partially or wholly neutralised with one or more monovalent or divalent metal ions.

Preferred metal ions M are monovalent metals ion such as lithium, sodium, potassium. The monovalent metal ions can be used alone or in combination with hydrogen, ammonium or divalent metal ions.

More preferably M is a divalent metal ion such calcium or magnesium. The divalent metal ions can be used alone or in combination with hydrogen, ammonium or monovalent metal ions. Most preferably the metal ion is magnesium.

The number of magnesium ions in the composition is typically 10-100% of the amount required for complete neutralisation, or, in another embodiment, 40-90%, or alternatively 60-80% neutralisation by magnesium. Since magnesium is normally a divalent ion, it can neutralise up to two phenolic hydroxy groups. The two hydroxy groups may be on the same or on different molecules. If the value of n is less than 1.0, this indicates that the hydroxy groups are less than completely neutralised by magnesium ions. Alternatively, each magnesium ion can be associated with one phenolic anion and an ion of another type such as a hydroxide ion or carbonate ion ($CO_3^{2-}$), while still providing an n value of 1.0.

The specification that the average value of n is 0.1 to 1.0 is not directly applicable to overbased versions of this material (described below and also a part of the present invention) in which an excess of Mg or another cation can be present. It should be understood that, even in an overbased material, some fraction of the phenolic OH groups may not have reacted with the magnesium and may retain the OH structure.

Most of the rings contain at least one $R^1$ substituent, which is a hydrocarbyl group, preferably an alkyl group, containing 1 to 60 carbon atoms, preferably 7 to 28 carbon atoms, more preferably 9 to 18 carbon atoms. It is understood that $R^1$ will normally comprise a mixture of various chain lengths, so that the foregoing numbers will normally represent an average number of carbon atoms in the $R^1$ groups (number average). $R^1$ can be linear or branched. Each ring in the structure will be substituted with 0, 1, 2, or 3 such $R^1$ groups (that is, p=0, 1, 2, or 3), most typically 1, although different rings in a given molecule may contain different numbers of such substituents. At least one aromatic ring in the molecule must contain at least one $R^1$ group, and the total number of carbon atoms in all the $R^1$ groups in the molecule segment should be at least 7, preferably at least 12.

In the above structure the X and Y groups may be seen as groups derived from formaldehyde or a formaldehyde source, by condensative reaction with the aromatic molecule. While various species of X and Y may be present in the molecules in question, the commonest species comprising X are —CHO (aldehyde functionality) and —$CH_2OH$ (hydroxymethyl functionality); similarly the commonest species comprising Y are —$CH_2$— (methylene bridge) and —$CH_2OCH_2$— (ether bridge).

In one embodiment, X is at least in part —CHO, and such —CHO groups comprise at least 10, 12, or 15 mole percent of the X and Y groups. Preferably the —CHO groups comprise 20 to 60 mole percent of the X and Y groups and more preferably 25 to 40 mole percent of the X and Y groups.

In another embodiment, X is at least in part —$CH_2OH$ and such —$CH_2OH$ groups comprise 10 to 50 mole percent of the X and Y groups, preferably 15 to 30 mole percent of the X and Y groups.

In an embodiment in which m is non-zero, Y is at least in part —$CH_2$—, and such —$CH_2$— groups comprise 25 to 55 mole percent of the X and Y groups, preferably 32 to 45 mole percent of the X and Y groups.

In another embodiment Y is at least in part —$CH_2OCH_2$—, and such —$CH_2OCH_2$— groups comprise 5 to 20 mole percent of the X and Y groups, and preferably 10 to 16 mole percent of the X and Y groups.

The relative amounts of the various X and Y groups depends to a certain extent on the conditions of synthesis of the molecules. Under many conditions the amount of —$CH_2OCH_2$— groups is relatively small compared to the other groups and is reasonably constant at 13 to 17 mole percent. Ignoring the amount of such ether groups and focusing on the relative amounts of the —CHO, —$CH_2OH$, and —$CH_2$— groups, it has been found that particularly preferred compositions have the following relative amounts of these three groups, the total of such amounts in each case being normalized to equal 100%:

—CHO: 15-100%, preferably 20-80%, more preferably 25-40%

—$CH_2OH$: 0-54%, preferably 2-46%, more preferably 10-40%

—$CH_2$: 0-64%, preferably 18-64%, more preferably 20-60%

Saligenin derivatives and methods of their preparation are described in greater detail in U.S. Pat. No. 6,310,009.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Salixarate Derivative

The salixarate component of the additive formulation can be represented by a substantially linear compound comprising at least one unit of formula (I) or formula (II):

(I)

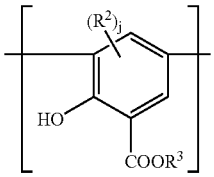

(II)

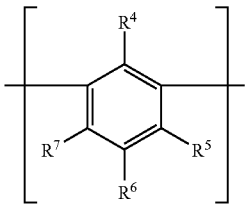

each end of the compound having a terminal group of formula (III) or formula (IV):

(III)

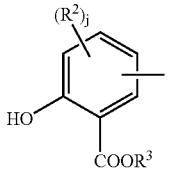

(IV)

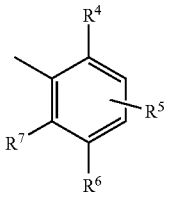

such groups being linked by divalent bridging groups A, which may be the same or different for each linkage; wherein in formulas (I)-(IV) $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1.

The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Preparative Example A. Overbased Salixarate

Step (a). A reactor is charged with 15 kg (23.3 moles) of polyisobutenyl ($\overline{M}_n$ 550) substituted phenol and 10.7 kg 150 N mineral oil. The materials are heated, under nitrogen, to 35° C., then 120 g (1.07 moles) aqueous KOH is added along with 100 mL distilled water wash. The mixture is heated to 75° C. over 0.5 hour and 2.6 kg (32.1 moles) of 37% aqueous formaldehyde is added over 0.5 hour along with 300 mL distilled water wash. The mixture is held at temperature for 2 hours, whereupon 1.65 kg salicylic acid (12 moles) is added followed by heating to 99° C. and reflux. The reaction mixture is further heated to 140° C. over 1 hour, removing 2.6 L aqueous distillate. The mixture is maintained at 140° C. for 1.5 hour at atmospheric pressure, followed by reduced pressure, collecting some additional aqueous distillate.

Step (b). A reactor is charged with 13.0 kg (8.95 moles) of the cooled product of step (a), 2.33 kg (31.5 moles) $Ca(OH)_2$, and 450 g ethylene glycol. While stirring, 7.38 kg of 2-ethylhexanol are added over 0.3 hours. The mixture is heated at 95° C. at reduced pressure over ¾ hour, followed by 130° C. over ¼ hour, during which time 0.5 L aqueous distillate is collected. An additional 2.16 kg ethylene glycol is added is added over about 0.3 hour at 125 to 130° C. Carbon dioxide is passed into the mixture under slight vacuum at 500 g/hour until a total of 750 g is added. After carbonation is complete, the temperature is increased to 200° C. and maintained for a total of about 2.2 hours, during which time 9.5 L aqueous distillate is collected. The product is an overbased calcium salixarate.

It is believed that a significant fraction of salixarate molecules (prior to neutralisation) may be represented on average by the following structure:

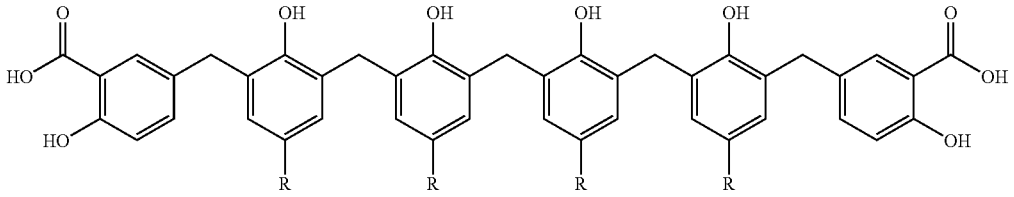

where each R is an alkyl group, and, in a preferred embodiment, is a polyisobutene group (especially of molecular weight 200-1,000, or about 550). Significant amounts of di- or trinuclear species may also be present containing one salicylic end group (III).

Sulphonate Derivative

The sulphonate component of the additive formulation can be represented by the formula:

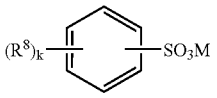

wherein, $R^8$ is independently alkyl, cycloalkyl, aryl, acyl, or hydrocarbyl groups with a 6 to 30 carbon atoms, and M is a metal ion. k is independently 1, 2, 3, or 4.

Preferred monovalent metal ions M include lithium, sodium, and potassium. The monovalent metal ions can be used alone or in combination with ammonium or divalent metal ions.

More preferably M is a divalent metal ion such calcium or magnesium. The divalent metal ions can be used alone or in combination with hydrogen, ammonium or monovalent metal ions. Most preferably the metal ion is calcium.

In one embodiment, k is 1 or 2 and $R^8$ is a branched or linear alkyl substituent with 6 to 40 carbons. More preferably, the alkyl substituent comprises 8 to 25 carbons. Even more preferably the alkyl substituent comprises 10 to 20 carbons. The most preferred sulphonate components are calcium polypropene benzenesulfonate and calcium mono and dialkyl (C>10) benzenesulfonate. Sulphonate derivatives and methods of their preparation are described in greater detail in "Chemistry and Technology of Lubricants", 2$^{nd}$ Edition, Edited by R. M. Mortier and S. T. Orszulik 1997.

Overbased Salts

Each of the sulfonate, saligenin, and salixarate can be overbased detergents. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulphonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The Optional Additional Detergent

If desired, an additional detergent may be present beside those described above. In one instance, it is understood that commercially available detergents of the sulphonate, salixarate, or saligenin type may be prepared in the presence of a small amount of another detergent. In other embodiments, the additional detergent or detergents may be separately added as additional components. Among the types of additional detergents that can be included are carboxylate detergents, and phenol-based detergents. Both the aforementioned salixarate detergent and the saligenin detergent may also be considered phenol based detergents in that they will contain phenolic functionality. For this reason the additional detergent, for clarity, is designated as being distinct from the salixarate or saligenin detergent. The phenol-based detergent can be a hydrocarbyl-substituted phenate detergent, a sulphurised hydrocarbyl-substituted phenate detergent, a formaldehyde linked hydrocarbyl-substituted phenate detergent, or a hydrocarbyl-substituted salicylate detergent. Salicylates are also carboxy-containing materials, but they will be generally considered herein as a species of a phenol-based detergent. The additional detergent will typically be overbased, as described above and using the general methods described above.

Carboxylic detergents are typically metal overbased carboxylic acids having a sufficiently long hydrocarbon moiety to promote oil solubility. They are well known commercial materials and can be prepared by known methods from aliphatic, cycloaliphatic, and aromatic mono- and polybasic carboxylic acids. They generally contain at least 8 carbon atom, preferably at least 12 carbon atoms, and typically up to 400 carbon atoms. Examples include 2-ethylhexanoic acid, linoleic acid, propylene-tetramer-substituted maleic acid, isostearic acid, oleic acid, dioctylcylopentanecarboxylic acid, and mixtures of acids such as tall oil acids and rosin acids. A more detailed listing and description of suitable carboxylic acids, and a list of references describing methods for preparing overbased salts thereof, is found in U.S. Pat. No. 5,824,626, columns 9-11.

Phenate detergents are typically metal overbased phenols having a sufficiently long hydrocarbon substituent to promote oil solubility. The phenols from which the phenates are formed are of the general formula $R_n(AR)—(XH)_m$. In this formula, R is an aliphatic hydrocarbon based (hydrocarbyl) group of at least 4 carbon atoms, and normally no more than 400 carbon atoms, n is an integer of 1 to 4, AR is a polyvalent aromatic hydrocarbon nucleus of up to 14 carbon atoms (preferably a benzene nucleus), each X is independently sulphur or oxygen, preferably oxygen, and m is an integer of 1 to 4. Preferably there is an average of at least 8 aliphatic carbon atoms provided by the R groups for each phenol molecule. Examples included hexylphenol, cyclohexylphenol, heptylphenol, nonylphenol, dodecylphenol, and other hydrocarbon-substituted phenols. Phenols and their conversion into phenate detergents described in greater detail in U.S. Pat. No. 5,824,626 (columns 11 and 12) and U.S. Pat. No. 3,372,116.

Other phenates that are useful are those that are made from phenols that have been linked through alkylene (e.g., methylene) bridges. These are made by reacting single or multi-ring phenols with aldehydes or ketones, typically in the presence of an acid or basic catalyst.

Sulphurised phenate detergents are prepared from phenols which have been sulphurised by reacting with a sulphurising agent such as sulphur, a sulphur halide, or sulphide or hydrosulphide salt, typically by mixing at a temperature above 60° C., depending on the reactivity of the sulphurising agent. The products include sulphides, polysulphides, and other products from such reaction. The molar ratio of the phenol to the sulphur compound can be from 1:0.5 to 1:1.5 or even higher. Synthesis of sulphurised phenate detergents is described in greater detail in U.S. Pat. No. 2,680,096 and U.S. Pat. No. 3,372,116, including columns 2 and 3.

Salicylate detergents can be considered a species of phenate detergent, since salicylic acid contains a phenolic OH group. They may also be considered a species of carboxylic acid, since salicylic acid contains a carboxy group, COOH. Typical salicylate detergents are metal overbased salicylates having a sufficiently long hydrocarbon substituent to promote oil solubility. Hydrocarbyl-substituted salicylic acids can be prepared by the reaction of the corresponding phenol by reaction of an alkali metal salt thereof with carbon dioxide. The hydrocarbon substituent can be as described for the carboxylate or phenate detergents. Overbased salicylic acid detergents and their preparation are described in greater detail in U.S. Pat. No. 3,372,116.

A preferred amount of the optional detergent is typically 0.1 to 2 percent by weight, or 0.12 to 1.2 percent, or 0.3 to 0.8 percent.

Oil of Lubricating Viscosity

The lubricating compositions and functional fluids of the present invention are based on diverse oils of lubricating viscosity, including natural and synthetic lubricating oils and mixtures thereof. Synthetic oils may be produced by Fischer-Tropsch reactions.

The lubricant compositions of this invention employ an oil of lubricating viscosity which is generally present in a major amount (i.e. an amount greater than 50% by weight). Generally, the oil of lubricating viscosity is present in an amount greater than 60%, or greater than about 70%, or greater than 80% by weight of the composition. In a concentrate, the amount of oil is correspondingly reduced.

Natural oils useful in making the inventive lubricants and functional fluids include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils are useful and include hydrocarbon oils such as polymerised and interpolymerised olefins (e.g., polybutylenes, polypropylenes, propyleneisobutylene copolymers,); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes,); polyphenyls (e.g., biphenyls, terphenyls, alkylated polyphenyls,); alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, and etherification, constitute another class of known synthetic lubricating oils that can be used. These are exemplified by the oils prepared through polymerisation of ethylene oxide or propylene oxide, the alkyl and aryl ethers of these polyoxyalkylene polymers (e.g., methyl-polyisopropylene glycol ether having a number average molecular weight of 1000, diphenyl ether of polyethylene glycol having a molecular weight of 500-1000, diethyl ether of polypropylene glycol having a molecular weight of 1000-1500) or mono- and polycarboxylic esters thereof, for example, the acetic acid esters, mixed $C_{3-8}$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol) Specific examples of these esters include dibutyl adipate, di-(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, and tripentaerythritol.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methylhexyl)silicate, tetra-(p-tert-butylphenyl) silicate, hexyl-(4-methyl-2-pentoxy) disiloxane, poly(methyl) siloxanes, and poly-(methylphenyl)siloxanes). Other synthetic lubricating oils include liquid esters of phosphorus-containing acids (e.g., tricresyl phosphate, trioctyl phosphate, and the diethyl ester of decane phosphonic acid), and polymeric tetrahydrofurans.

Unrefined, refined and re-refined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, Re-refined oils are obtained by processes similar to those used to obtain refined oils applied to refined oils which have been already used in service. Such re-refined oils are also known as reclaimed or reprocessed oils and often are additionally processed by techniques directed to removal of spent additives and oil breakdown products.

Oils of lubricating viscosity can also be defined as specified in the American Petroleum Institute (API) Base Oil Interchangeability Guidelines. The five base oil groups are as follows:

| Base Oil Category | Sulphur (%) | | Saturates (%) | Viscosity Index |
|---|---|---|---|---|
| Group I | >0.03 | and/or | <90 | 80-120 |
| Group II | ≦0.03 | and | ≧90 | 80-120 |
| Group III | ≦0.03 | and | ≧90 | ≧120 |
| Group IV | All polyalphaolefins (PAOs) | | | |
| Group V | All others not included in Groups I, II, III, or IV | | | |

Groups I, II, and II are mineral oil base stocks. In one embodiment, the oil of lubricating viscosity in the present invention comprises a Group II, III, IV, or V oil or mixtures thereof. That is, a major portion of the oil can be of group II through V, optionally mixed with a minor portion of Group I oil.

The Antioxidant

In a further embodiment, the lubricating oil composition may also contain an antioxidant. Antioxidants for use in lubricant compositions are well known and include a variety of chemical types including phenate sulfides, phosphosulfurised terpenes, sulfurised esters, aromatic amines, and hindered phenols.

A preferred antioxidant is a sterically hindered phenol. Such antioxidants are typically alkyl phenols of the formula:

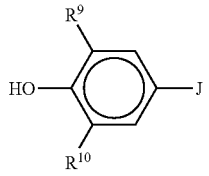

wherein $R^9$ and $R^{10}$ are independently branched or linear alkyl groups containing 1 up to 24 carbon atoms. Preferably $R^9$ and $R^{10}$ contain 4 to 18 carbon atoms and most preferably from 4 to 12 carbon atoms. $R^9$ and $R^{10}$ may be either straight chained or branched chained; branched chained is generally preferred. Preferably the phenol is a butyl substituted phenol containing two t-butyl groups. When the t-butyl groups occupy the 2,6-position, that is, the phenol is sterically hindered. J is H, hydrocarbyl, or a bridging group between two such aromatic groups. Bridging groups in the para position (J) include —$CH_2$— (methylene bridge) and —$CH_2OCH_2$— (ether bridge).

A particularly preferred antioxidant is a hindered, ester-substituted phenol such as one represented by the formula:

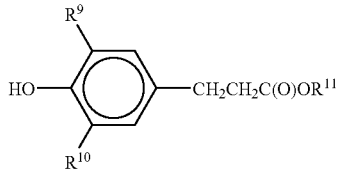

wherein $R^{11}$ is a straight chain or branched chain alkyl group containing 2 to 22 carbon atoms, preferably 2 to 8, 2 to 6, or 4 to 8 carbon atoms and more preferably 4 or 8 carbon atoms. $R^{11}$ is desirably a 2-ethylhexyl group or an n-butyl group.

In one embodiment an aromatic amine antioxidant is used in combination with the additive formulation and the sterically hindered phenol. The aromatic amines can be represented by the formula:

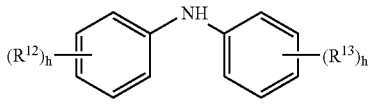

wherein $R^{12}$ and $R^{13}$ are independently a hydrogen or an arylalkyl group or a linear or branched alkyl group containing 1 to 24 carbon atoms and h is independently 0, 1, 2, or 3, provided that at least one aromatic ring contains an arylalkyl group or a linear or branched alkyl group. Preferably $R^{12}$ and $R^{13}$ are alkyl groups containing from 4 to 20 carbon atoms. A preferred embodiment is an alkylated diphenylamine such as nonylated diphenylamine of the formula:

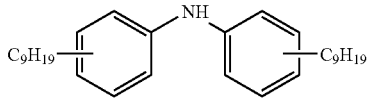

Dispersants

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Dispersants are characterised by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde. Such materials (including a variety of isomers) and are described in more detail in U.S. Pat. No. 3,634,515.

Another class of dispersants is succinimide compounds. These materials are formed by the reaction of a hydrocarbyl substituted succinic acylating agent and an amine. A more detailed description of succinimide compounds suitable for the invention are described in European patent 976 814.

Another class of dispersants is high molecular weight esters. This class of dispersant is described in more detail in U.S. Pat. No. 3,381,022.

Other dispersants include polymeric dispersant additives, which are generally hydrocarbon-based polymers which contain polar functionality to impart dispersancy characteristics to the polymer.

A preferred class of dispersants is the carboxylic dispersants. Carboxylic dispersants include succinic-based dispersants, which are the reaction product of a hydrocarbyl substituted succinic acylating agent with an organic hydroxy compound or, preferably, an amine containing at least one hydrogen attached to a nitrogen atom, or a mixture of said hydroxy compound and amine. The term "succinic acylating agent" refers to a hydrocarbon-substituted succinic acid or succinic acid-producing compound. Such materials typically include hydrocarbyl-substituted succinic acids, anhydrides, esters (including half esters) and halides. Succinimide dispersants are more fully described in U.S. Pat. No. 4,234,435.

Antiwear Agents

The lubricant may additionally contain a antiwear agent. Useful antiwear agents include but are not limited to a metal thiophosphate, especially a zinc dialkyldithiophosphate; a phosphoric acid ester or salt thereof; a phosphite; and a phosphorus-containing carboxylic ester, ether, or amide. A more detailed discussion and examples of phosphorus containing compounds suitable as antiwear agents is discussed in European patent 612 839.

Boron Containing Compounds

The lubricant may additionally contain one or more borated compounds. Useful borated compound include borate esters, borated fatty amines, borated epoxides, and borated dispersants such as borated succinimide dispersants, such as are disclosed in U.S. Pat. No. 5,883,057, columns 29-33. Some useful boron-containing compounds may be represented by one or more of the formulas (B-I)

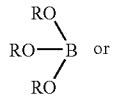

(B-II)

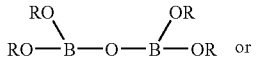

(B-III)

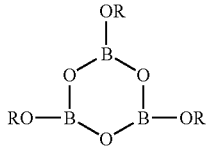

where each R is independently an organic group and any two adjacent R groups may together form a cyclic group. In one embodiment, R is a hydrocarbyl group. The total number of carbon atoms in the R groups in each formula should be sufficient to render the compound soluble in base oil. Generally, the total number of carbon atoms in the R groups is at least 8 or at least 12. There is no rigid limit to the total number of carbon atoms in the R groups, but a practical upper limit is 400 or 500 carbon atoms. Examples of useful R groups include isopropyl, n-butyl, isobutyl, amyl, 4-methyl-2-pentyl, 2-ethyl-1-hexyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, and alkylnaphthylalkyl.

In certain embodiments, the boron-containing compound can be represented by the formulas $B(OC_5H_{11})_3$ or $B(OC_4H_9)_3$ or $B(O—CH_2—CH(C_2H_5)—C_4H_9)_3$. A useful boron-containing compound is available from Mobil under the trade designation MCP-1286, identified as a borated ester.

The boron-containing compound (B) can be a compound represented by the formula (B-I-1)

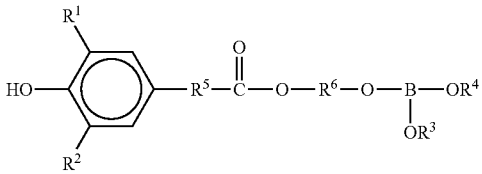

where: $R^1$, $R^2$, $R^3$ and $R^4$ are independently hydrocarbyl groups of 1 to 12 carbon atoms; and $R^5$ and $R^6$ are independently alkylene groups of 1 to 6 carbon atoms, and in one embodiment 2 to 4 carbon atoms. A useful phenolic borate is available from Crompton Corporation under the trade designation LA-2607.

The boron-containing compound can be a compound represented by the formula:

(B-II-1)

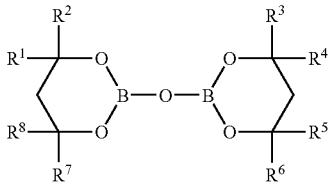

where: $R^1$, $R^2$, $R^3$, $R^4$, $R^5$, $R^6$, $R^7$ and $R^8$ are independently hydrogen or hydrocarbyl groups. Each of the hydrocarbyl groups may contain from 1 to 12 carbon atoms, and in one embodiment 1 to 4 carbon atoms. An example is 2,2-oxy-bis-(4,4,6-trimethyl-1,3,2-dioxaborinane).

The boron-containing compound may be employed in the lubricating oil composition at a sufficient concentration to provide a boron concentration of 0.01 to 0.2% by weight, or 0.015 to 0.12% by weight, or 0.05 to 0.1% by weight. A discussion and examples of certain alkylated borates is found in European patent 976 814.

Friction Modifiers

The lubricant may additionally contain a friction modifier. Useful friction modifiers include fatty amines, esters, especially glycerol esters such as glycerol monooleate, borated glycerol esters, fatty phosphites, fatty acid amides, fatty epoxides, borated fatty epoxides, alkoxylated fatty amines, borated alkoxylated fatty amines, metal salts of fatty acids, sulfurized olefins, fatty imidazolines, condensation products of carboxylic acids and polyalkylene-polyamines, amine salts of alkylphosphoric acids, and molybdenum-containing friction modifiers such as molybdenum dithiocarbamates. Among suitable molybdenum friction modifiers are molybdenum and sulfur-containing compositions derived from a molybdenum compound, a basic nitrogen-containing compound, and carbon disulfide. The basic nitrogen compound can be a hydrocarbyl amine or a reaction product of a carboxylic acid with an alkylene polyamine. The molybdenum compound can be an acidic Mo compound such as molybdic acid. An example of such a friction modifier is the reaction product of polyethyleneamine bottoms with isostearic acid, further treated with $MoO_3$ and $H_2O$ and then carbon disulphide.

Viscosity Modifiers

The lubricant may additionally contain a viscosity modifier. Viscosity modifiers comprising from polyolefins or polyacrylates are well known in the art.

The lubricating compositions are particularly effective as engine lubricating oils having enhanced antiwear properties. These lubricating compositions are effective in a variety of applications including crankcase lubricating oils for spark-ignited and compression-ignited internal combustion engines, including automobile and truck engines, two-cycle engines, aviation piston engines, marine and low-load diesel engines.

EXAMPLES

The following examples illustrate the invention. It should however be noted that these examples are non exhaustive and not intended to limit the scope of the invention.

Example 1

Preparation of a Conventional Lubricant Formulation (Comparative)

Hereinafter the term "CLF" is used for the Conventional Lubricant Formulation. A CLF 10 W-30 formulation is prepared containing 95 percent of 200N API Group 3 base oil, 7 $mm^2s^{-1}$ (cSt) at 100° C. and 5 percent of 100N Group 3 base oil, 4 $mm^2s^{-1}$ (cSt) at 100° C. Additionally, 3.5 percent of a viscosity modifier (olefin copolymer) and 0.3 percent pour point depressant are added to the lubricant formulation.

The following additives are added to the 10 W-30base oil formulation (weight percents based on the total lubricant formulation):

| | |
|---|---|
| 7.2% | Succinimide dispersant(s), 50% chemical in diluent oil |
| 2.1% | Calcium sulphonate detergent(s), including diluent oil |
| 1.6% | Calcium phenate detergent(s), including diluent oil |
| 1.15% | ZDDP antiwear agent, including diluent oil |
| 0.50% | Sulphur-containing antioxidant |
| 0.03% | Copper passivator |
| 0.4% | Additional diluent oil |
| 100 ppm | Silicone antifoam agent (commercial) |

Example 2

Preparation of Inventive Lubricant Formulation

Hereinafter the term "ILF" is used for the Inventive Lubricant Formulation. A ILF 10 W-30 formulation is prepared containing 87 percent of 200N API Group 3 base oil, 7 $mm^2s^{-1}$ (cSt) at 100° C. and 13 percent of 100N Group 3 base oil, 4 $mm^2s^{-1}$ (cSt) at 100° C. Additionally, 2.7 percent of a viscosity modifier (olefin copolymer) and 0.3 percent pour point depressant are added to the lubricant formulation.

The following additives are added to the 10 W-30base oil formulation (weight percents based on the total lubricant formulation):

| | |
|---|---|
| 10.0% | Succinimide dispersant(s), ~60% chemical in diluent oil |
| 0.50% | ZDDP antiwear agent, 91% active chemical in diluent oil |
| 1.3% | Borate ester |
| 2.1% | Magnesium saligenin detergent, about 63 TBN, prepared from dodecyl-phenol and paraformaldehyde (as prepared in U.S. Pat. No. 6,310,009, Example 1), 50% chemical in diluent oil. |
| 1.9% | 150 TBN Calcium Salixarate (as prepared in preparative example A), 65% chemical in diluent oil |
| 0.6% | 400 TBN Overbased calcium alkylbenzene sulphonate detergent, 58% chemical in diluent oil |
| 4% | Hindered phenolic ester antioxidant |
| 1.5% | Aromatic amine antioxidant |
| 0.6% | Sulphur-containing antioxidant |
| 0.01% | Silicone defoamer (commercial material containing about 90% diluent) |

Samples of the formulations described above are evaluated for their performance in wear, oxidation, seal compatibility, elemental analysis, ash content and deposit tests.

Test 1

Elemental analysis studies are carried out on CLF and ILF samples. The results obtained are presented in Table 1.

TABLE 1

| Element | Elemental Analysis CLF (wt %) | ILF (wt %) |
|---|---|---|
| B | | 0.0524 |
| Ca | 0.2759 | 0.1804 |
| Mg | | 0.0317 |
| P | 0.1147 | 0.0492 |
| S | 0.4090 | 0.1977 |
| Si | <0.001 | <0.001 |
| Zn | 0.1280 | 0.0563 |

The analysis indicates ILF contains significantly less sulphur, phosphorus, zinc and calcium.

Test 2

The amount of deposition is established using the Panel Coker Deposit Test. In this test, the sample, at 105° C., is splashed for 4 hours on an aluminium panel maintained at 325° C. The aluminium plates are analysed using image analysis techniques to obtain a universal rating. The rating score is based on 100 being a clean plate and 0 a plate wholly covered in deposit. The universal ratings obtained for CLF and ILF samples are 28 and 86 respectively. The higher universal rating for the ILF sample indicates significant improvements over the CLF sample.

Test 3

The amount of viscosity increase caused by lubricant oxidation in marine trunk piston engine oils is established, by measuring the viscosity at 40° C. before and after heating the oil to 200° C. and holding for 24 hours. Air is blown into the system at a 25 cc $min^{-1}$. Lower percentage viscosity increases indicate better performance. The results obtained for CLF and ILF samples are:

| | CLF | ILF |
|---|---|---|
| 0 hours viscosity at 40° C. | 69.57 | 74.08 |
| 24 hours viscosity at 40° C. | 109.247 | 99.24 |
| Percentage viscosity increase | 57 | 34 |

The analysis indicates lubricating oils with ILF have viscosity increases significantly less than those with CLF.

Test 4

Seal compatibility tests are designed to evaluate the effect of motor oils on Parker-Pradifa™ FKM E-281 seal elastomers (fluoroelastomer). Six dumb-bells of elastomer are suspended using a micro wire and glass separators are covered by at least 10 ml of oil. The test vessel is covered with aluminium foil and stored at 150° C. for 96 hours. The elastomer is removed from the oil and tested for percentage change in tensile strength, elongation, and cracking (by bending). The results obtained for CLF and ILF samples are:

| | CLF | ILF |
|---|---|---|
| tensile change | −47.2 | −18.9 |
| elongation change | −43.3 | −24.4 |
| bend test | cracked | not cracked |

The analysis indicates lubricating oils with ILF have improved seal compatibility over those with CLF, that is, compared with a control formulation with the combination of calcium sulphonate and calcium phenate detergents, without the saligenin and salixarate detergents.

Test 5

Nitration experiments are carried out on 40 gram oil samples by mixing 0.17 ml of 6N nitric acid and 0.09 ml of 0.5% iron naphthenate into the oil and heating to 145° C. for 22 hours. $NO_x$ is blown into the system at a rate of 25 cc $min^{-1}$. The sample of oil is removed and analysed for changes in the FTIR profile for $RONO_2$, a characteristic nitration functionality, by appearance of the corresponding peak in the IR Samples with small changes in FTIR peak profile (peak height) for $RONO_2$ are nitrated least. The results obtained for CLF and ILF samples are:

| | CLF | ILF |
|---|---|---|
| $RONO_2$ | 9.5 | 7.3 |

The analysis indicates lubricating oils with ILF are less susceptible to nitration than are oils with CLF.

Test 6

A High Temperature Cummins Bench Test (HTCBT) is carried out on lubricants to determine their tendency to corrode various metals, specifically lead and copper. Four metal samples of copper, lead, tin and phosphor bronze are immersed in 100 ml of oil and heated to 135° C. for 168 hours with 5 litres of air per hour purging the sample. The ppm levels of copper and lead in the oil are determined at the end of the test. The results obtained for CLF and ILF samples are:

| HTCBT Test Data | CLF | ILF |
|---|---|---|
| Copper (ppm) | 10 | 6 |
| Lead (ppm) | 41 | 2 |

The analysis indicates lubricating oils with ILF have improved resistance to corroding copper and lead over oil with CLF.

Test 7

Pressure Differential Scanning Calorimetry (PDSC) is used to determine the ability of oil to resist oxidation. 3 mg of sample is placed in an aluminium pan and isothermally heated to 210° C. and pressurised with oxygen to 3.5 MPa (500 PSIG). The results obtained for CLF and ILF samples are:

| PDSC Oxidation Test | CLF | ILF |
|---|---|---|
| Onset time (minutes) | 25.4 | 108.8 |

The analysis indicates lubricating oils with ILF have improved resistance to oxidation over those with CLF.

The results presented in tests 1-7 illustrate the significant reduction in ash, sulphur, and phosphorus in the engine oils of the present invention. The inventive additive formulation produces improved antioxidancy, seal compatibility, and cleanliness over conventional formulations.

Example 3

Preparation of a Low Emission Formulation with a Conventional Detergent System (Comparative)

Hereinafter the term "LEF CDS" is used for the Low Emission Formulation using the Conventional Detergent System. A LEF CDS 10 W-30 formulation is prepared containing 87 percent of 200N API Group 3 base oil, 7 $mm^2s^{-1}$ (cSt) at 100° C. and 13 percent of 100N Group 3 base oil, 4 $mm^2s^{-1}$ (cSt) at 100° C. Additionally, 2.7 percent of a viscosity modifier (olefin copolymer) and 0.3 percent pour point depressant are added to the lubricant formulation.

The following additives are added to the 10 W-30 base oil formulation (weight percents based on the total lubricant formulation):

| | |
|---|---|
| 10.0% | Succinimide dispersant(s), ~60% chemical in diluent oil |
| 0.50% | ZDDP antiwear agent (91% active chemical in diluent oil) |
| 1.3% | Borate ester |
| 1.6% | Calcium sulphonate detergent(s) including diluent oil |
| 1.6% | Calcium phenate detergent(s) including diluent oil |
| 4% | Hindered phenolic ester antioxidant |
| 0.01% | Silicone defoamer (commercial material containing about 90% diluent) |

Example 4

Preparation of a Low Emission Formulation with the Inventive Detergent System

Hereinafter the term "LEF IDS" is used for the Low Emission Formulation using the Inventive Detergent System. A LEF IDS 10 W-30 formulation is prepared identical to the material of Example 3, except that the 0.9% calcium sulphonate detergent, the 0.73% overbased calcium sulphonate detergent, the 0.76% calcium phenate detergent, and the 0.87% overbased calcium phenate detergent, are replaced by the following detergent mixture:

2.1% Magnesium saligenin detergent, about 63 TBN, prepared from dodecylphenol and paraformaldehyde (as prepared in U.S. Pat. No. 6,310,009, Example 1), 50% chemical in diluent oil.

1.9% 150 TBN Calcium salixarate as prepared in Preparative Example A, 65% chemical in diluent oil 0.6% 400 TBN Overbased calcium alkylbenzene sulphonate detergent, 58% chemical in diluent oil Samples of the formulations described above are evaluated for their performance in wear, oxidation, seal compatibility, elemental analysis, ash content and deposit tests.

Test 1

Elemental analysis studies are carried out on LEF CDS and LEF IDS samples. The results obtained are presented in Table 1.

TABLE 1

| Elemental Analysis | | |
|---|---|---|
| Element | LEF CDS (wt %) | LEF IDS (wt %) |
| B | 0.0537 | 0.0542 |
| Ca | 0.2265 | 0.1830 |

TABLE 1-continued

| Elemental Analysis | | |
|---|---|---|
| Element | LEF CDS (wt %) | LEF IDS (wt %) |
| Mg | 0.0000 | 0.0330 |
| P | 0.0528 | 0.0518 |
| S | 0.2263 | 0.1254 |
| Si | <0.001 | 0.0015 |
| Zn | 0.0593 | 0.0583 |

Test 2

The amount of deposition is established using the Panel Coker Deposit Test as described above. The universal ratings obtained for LEF CDS and LEF IDS samples are 14 and 37 respectively. The higher universal rating for the LEF IDS sample indicates significant improvements over the LEF CDS sample.

Test 3

The amount of viscosity increase caused by lubricant oxidation in marine trunk piston engine oils is established as described above. The results obtained for LEF CDS and LEF IDS samples are:

| | LEF CDS | LEF IDS |
|---|---|---|
| 0 hours viscosity at 40° C. | 70.69 | 73.48 |
| 24 hours viscosity at 40° C. | 81.38 | 88.67 |
| Percentage viscosity increase | 15.1 | 20.7 |

The analysis indicates LEF's with IDS have viscosity increases comparable to those with CDS.

Test 4

Seal compatibility tests are conducted to evaluate the effect of motor oils on Parker-Pradifa™ FKM E-281 seal elastomers (fluoroelastomer) as described above. The results obtained for LEF CDS and LEF IDS samples are:

| | LEF CDS | LEF IDS |
|---|---|---|
| tensile change | −47.6 | −5.2 |
| elongation change | −36.4 | −20.2 |
| bend test | cracked | not cracked |

The analysis indicates LEF's with IDS have improved seal compatibility over those with CDS.

Test 5

Nitration experiments are carried out as described above. The results obtained for LEF CDS and LEF IDS samples are:

| | LEF CDS | LEF IDS |
|---|---|---|
| $RONO_2$ | 12.9 | 11.1 |

The analysis indicates LEF's with IDS are comparable or superior in susceptibility to nitration to those with CDS.

Test 6

A High Temperature Cummins Bench Test (HTCBT) is carried out as described above. The results obtained for LEF CDS and LEF IDS samples are:

| HTCBT Test Data | LEF CDS | LEF IDS |
|---|---|---|
| Copper (ppm) | 4 | 2 |
| Lead (ppm) | 4 | 1 |

The analysis indicates LEF's with IDS have comparable resistance to corroding copper and lead to oil with CDS.

Test 7

Pressure Differential Scanning Calorimetry (PDSC) is used to determine the ability of the samples to resist oxidation, as described above The results obtained for LEF CDS and LEF IDS samples are:

| PDSC Oxidation Test | LEF CDS | LEF IDS |
|---|---|---|
| Onset time (minutes) | 48.8 | 74.9 |

The analysis indicates LEF's with IDS have improved resistance to oxidation over those with CDS.

Examples 5 and 6

The following formulations are prepared and are subjected to the API CH-4 Cummins M11 Engine test. This test uses a Cummins™ 370-E block engine, which is an electronically governed in-line 6-cylinder 4-stroke, compression ignition engine. The test is conducted in four 50-hour stages. During the first and third stages, the engine is over-fueled and operated with retarded timing to generate soot at an accelerated rate. During the second and fourth stages the engine is run at lower speed and higher torque, to induce wear. The crosshead wear, considered to be representative of valve train wear, is determined and averaged for 12 crossheads. A passing criterion is considered to be an average weight loss of 6.5 mg or less.

In examples 5 and 6, the amounts of salixarate detergent (Ex. 6) and salicylate detergent (Ex. 5, comparative) are selected to deliver equal amounts of metal, expressed as sulphated ash, the salicylate being a more highly overbased material.

| Component (parts by weight) | Ex. 5 (comparative) | Ex. 6 |
|---|---|---|
| Mixture of 100 N and 200 N API Group III oils | 100 | 100 |
| Viscosity modifier (including diluent oil) | 2.7 | 2.7 |
| Pour point depressant (including diluent oil) | 0.3 | 0.3 |
| 63 TBN Overbased Mg saligenin detergent as described in Ex. 2 (including 50% oil) | 2.1 | 2.1 |
| 400 TBN Overbased Ca sulphonate detergent (42% oil) | 0.6 | 0.6 |
| 150 TBN Overbased Ca salixarate detergent of Ex. A (35% oil) | | 1.9 |
| 280 TBN Overbased Ca salicylate detergent (45% oil) | 0.95 | |

-continued

| Component (parts by weight) | Ex. 5 (comparative) | Ex. 6 |
|---|---|---|
| Succinimide dispersants (average 39% oil) | 10 | 10 |
| ZDDP (9% oil) | 0.5 | 0.5 |
| Phenolic antioxidant | 4 | 4 |
| Dioxylborane (structure B-II-1 where $R^1$ and $R^3$ are H and the remaining Rs are $CH_3$) | 0.75 | 0.75 |
| Antifoam agent (commercial) | 0.01 | 0.01 |
| M11 Average Crosshead Wear (mg) | 10.6 | 5.7 |

Example 7

Example 6 is repeated except that the dioxylborane is replaced by 1.3 parts n-butyl borate ester.

Examples 8 and 9

Example 7 is repeated except that the detergent component (saligenin, sulphonate, and salixarate, above) is replaced by the following detergent components, in parts by weight:

| Detergent component (parts by weight) | Ex. 8 | Ex. 9 |
|---|---|---|
| 63 TBN Overbased Mg saligenin detergent as described in Ex. 2 (including 50% oil) | 1.05 | 1.05 |
| 400 TBN Overbased Ca sulphonate detergent (42% oil) | 0.45 | 0.45 |
| 150 TBN Overbased Ca salixarate detergent of Ex. A (35% oil) | 1.3 | 1.3 |
| 255 TBN Overbased Ca dodecyl phenate sulphide detergent (39% oil) | 0.75 | — |
| 165 TBN Overbased Ca alkyl salicylate detergent (40% oil) | — | 1.15 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method of lubricating a compression-ignited internal combustion engine, comprising supplying thereto a lubricant composition comprising:

(a) about 0.05 to about 1.5 weight percent of a calcium or magnesium sulphonate detergent;

(b) about 0.2 to about 2 weight percent of a calcium salixarate detergent;

(c) about 0.2 to about 1.7 weight percent of a magnesium saligenin detergent; and (d) an oil of lubricating viscosity in an amount up to about 99.75 weight percent, wherein the composition has a total sulphur content of below about 0.5 weight percent and a total phosphorus content of below about 0.1 weight percent.

2. The method according to claim 1, wherein said saligenin detergent is represented by the formula:

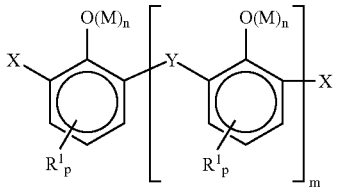

wherein, X comprises —CHO or —$CH_2OH$, Y comprises —$CH_2$— or —$CH_2OCH_2$—, and wherein such —CHO groups comprise at least about 10 mole percent of the X and Y groups; M is a calcium, magnesium, lithium, potassium or sodium ion; each n is independently 0 or 1; $R^1$ is a hydrocarbyl group containing 1 to about 60 carbon atoms; m is 0 to about 10, and when m>0, one of the X groups can be H; each p is independently 0, 1, 2 or 3; and the total number of carbon atoms in all $R^1$ groups is at least 7.

3. The method according to claim 1, wherein said salixarate detergent is represented by a substantially linear compound comprising at least one unit of formula (I) or formula (II):

(I)

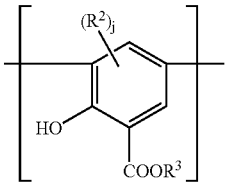

(II)

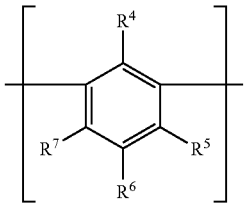

each end of the compound having a terminal group of formula (III) or formula (IV):

(III)

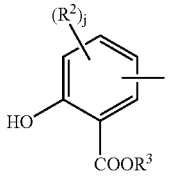

(IV)

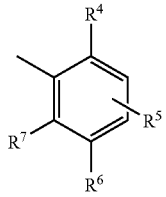

such groups being linked by divalent bridging groups A, which may be the same or different for each linkage; wherein in formula (I)-(IV) it $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in The method is about 0.1:1 to about 2:1.

4. The method of claim 1 further comprising (d) an additional mono- or divalent metal detergent other than those of (a), (b), or (c).

5. The method of claim 4 wherein the detergent of (d) is based on a phenolic or carboxylic compound.

6. The method of claim 5 wherein the detergent of (d) is a hydrocarbyl-substituted phenate, a sulfurized hydrocarbyl-substituted phenate, or a hydrocarbyl-substituted salicylate.

7. The method according to claim 1, wherein the total sulphated ash content is below about 1.1 weight percent.

8. The method of claim 1 further comprising an effective amount of a sterically hindered phenol antioxidant and optionally an aromatic amine antioxidant.

9. The method of claim 8, wherein the total antioxidant content is about 0.1 to about 15 weight percent.

10. The method of claim 8, wherein the hindered phenol antioxidant is represented by the formula:

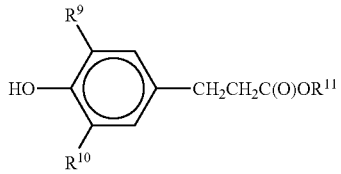

wherein $R^9$ and $R^{10}$ are independently branched or linear alkyl groups containing 1 to about 24 carbon atoms, and $R^{11}$ is a straight chain or branched chain alkyl group containing 2 to about 22 carbon atoms.

11. The method of claim 1 further comprising a friction modifier.

12. The method of claim 11 wherein the friction modifier is a molybdenum compound.

13. The method of claim 1 further comprising a borate ester or a borated succinimide dispersant.

14. The method of claim 1 further comprising an antiwear agent.

15. The method of claim 14 wherein the antiwear agent comprises a zinc dialkyl dithiophosphate.

16. The method of claim 1 further comprising a dispersant.

17. The method of claim 1 wherein the oil of lubricating viscosity comprises an API Group II, Group III, Group IV, or Group IV oil or mixtures thereof.

* * * * *